United States Patent [19]

Thorneburg

[11] 4,047,400

[45] Sept. 13, 1977

[54] MOISTURE ABSORBENT BAND

[75] Inventor: James L. Thorneburg, Statesville, N.C.

[73] Assignee: Thorneburg Hosiery Mill, Inc., Statesville, N.C.

[21] Appl. No.: 722,679

[22] Filed: Sept. 13, 1976

[51] Int. Cl.[2] ..... D04B 1/02; D04B 1/18; D04B 1/24

[52] U.S. Cl. ..... 66/171; 2/170; 66/173; 66/190; 66/194

[58] Field of Search ..... 66/170, 169 R, 196, 66/194, 171, 173, 190; 2/170

[56] References Cited

U.S. PATENT DOCUMENTS

| | | | |
|---|---|---|---|
| 1,915,092 | 6/1933 | Hendrickson | 66/171 |
| 2,643,389 | 6/1953 | Wegner | 2/170 |
| 2,747,390 | 5/1956 | Reymes-Cole | 66/173 |
| 3,250,095 | 5/1966 | Bird | 66/194 X |
| 3,561,441 | 2/1971 | Lombardi | 66/194 X |
| 3,600,909 | 8/1971 | Kaplan | 66/171 |
| 3,757,539 | 9/1973 | Millar | 66/173 |
| 3,796,067 | 3/1974 | East | 66/194 X |

OTHER PUBLICATIONS

Wignal, *Hosiery Technology*, 1968, National Knitted Outerwear Association, pp. 21,22.

*Primary Examiner*—Wm. Carter Reynolds
*Attorney, Agent, or Firm*—Bell, Seltzer, Park & Gibson

[57] ABSTRACT

The band is of the type commonly known as a "sweatband" adapted to be worn around the wrist or head when playing tennis and other sports. The band is knit with at least some moisture absorbent yarn and is completely formed on a circular knitting machine. The band includes inner and outer integrally knit plies and is usually provided with terry loops extending outwardly from each ply. The inner ply includes first and second sections with adjacent edges joined together with an integrally knit narrow connector tab including twice as many wales as the inner and outer plies.

11 Claims, 5 Drawing Figures

MOISTURE ABSORBENT BAND

Figure 1:
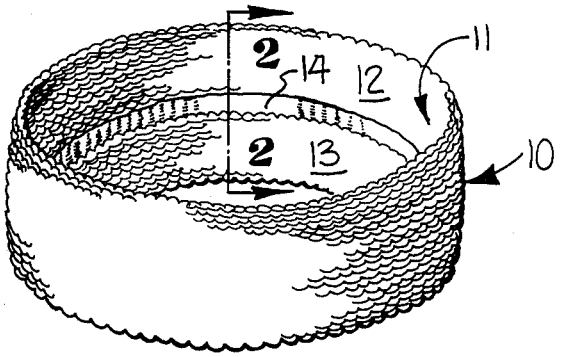

This invention relates generally to a moisture absorbent band of the type commonly known as a "sweatband" and to a method of completely forming the band on a circular knitting machine without requiring any additional sewing operation.

Sweatbands are normally formed by knitting a long tube of seamless fabric, usually with terry loops on the inside surface thereof, cutting the seamless tube in predetermined lengths of twice the desired width of the sweatband, turning half of the seamless tube outwardly over the other half to position the terry loops on the outer surface of the outer half or ply and on the inner surface of the inner half or ply, sewing together opposite ends of the predetermined length of tubular fabric, and then flattening the sewn tubular fabric so that the seam is positioned in an intermediate location on the inner ply thereof. The cutting, turning and seaming of the tubular fabric requires additional steps which increase the cost of manufacture of this type of band. Also, the seam on the inner ply of the band may limit stretchability of the band and may irritate the wearer.

With the foregoing in mind, it is an object of the present invention to provide a moisture absorbent band and method of forming the same which is completely formed on a circular knitting machine so that no cutting, turning and sewing operations are required.

In accordance with the present invention, the moisture absorbent band may be knit of a size adapted to be worn around the wrist or it may be knit of a larger size that it may be worn around the head. The moisture absorbent band is knit with at least some moisture absorbent yarn to form a first or outer cylindrical ply of knit fabric of predetermined width and including successive courses of body yarn stitch loops extending circumferentially of the first ply of fabric and defining parallel wales of stitch loops extending perpendicularly of the courses and from one side to the other of the first ply. A second or inner cylindrical ply of knit fabric of predetermined width is integrally knit at opposite side edges thereof with corresponding opposite side edges of the first ply. The second ply is divided intermediate opposite side edges thereof to define first and second cylindrical sections. A single layer connector tab of knit fabric of a relatively narrow width connects and integrally joins the adjacent edges of the first and second sections of the second ply together and extends outwardly therefrom.

The band is preferably knit with a stretchable body yarn and may include a moisture absorbent terry yarn knit in plated relationship with the body yarn in either one or both of the inner and outer plies to form terry loops extending outwardly therefrom. The band may also include an elastic yarn inlaid with the body yarn stitch loops in either one or both of the inner and outer plies. The body yarn may be moisture absorbent, such as cotton or a blend of cotton and synthetic, and a stretchable or elastic yarn may be incorporated in the band to provide stretchability and a snug fit on the wearer.

Figure 2:
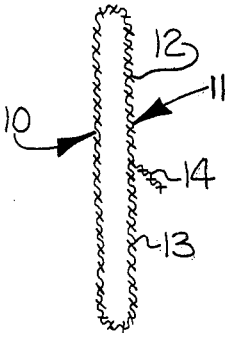
Figure 3:
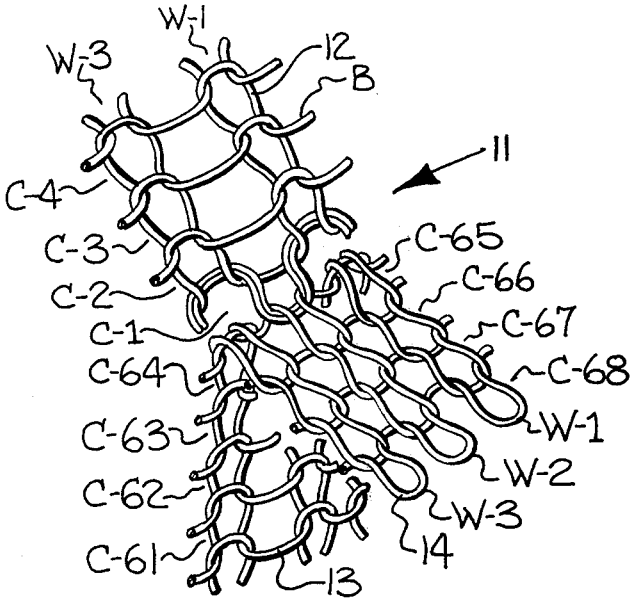
Figure 4:
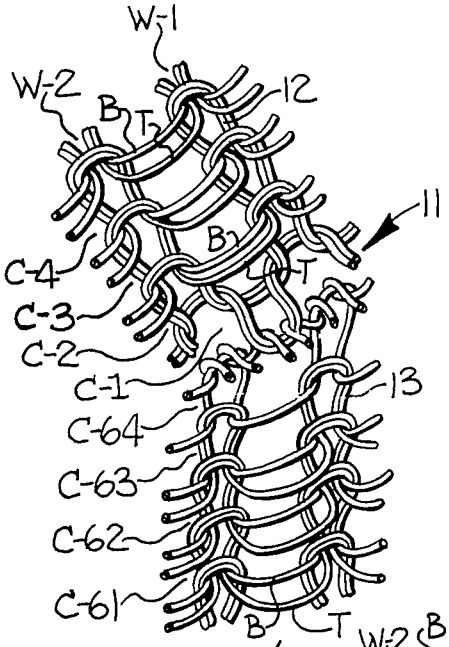
Figure 5:
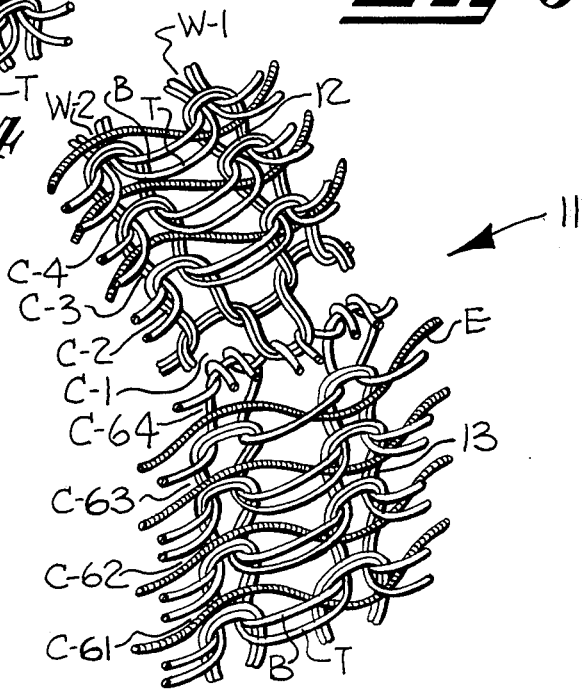

Other objects and advantages will appear as the description proceeds when taken in connection with the accompanying drawings in which FIG. 1 is a perspective view of the moisture absorbent band of the present invention of a size adapted to fit the wrist;

FIG. 2 is an enlarged, somewhat schematic, vertical sectional view illustrating the double ply character of the band and being taken substantially along the line 2—2 in FIG. 1;

FIG. 3 is a greatly enlarged view of a fragmentary portion of the inner central portion of the band, looking in the direction of the arrow 3 in FIG. 2, and illustrating the manner in which the stitch loops of the initial or make-up course of the single layer connector tab are integrally knit with the initial course of the first section and with the final course of the second section of the inner ply;

FIG. 4 is a view similar to FIG. 3 but with the single layer connector tab being broken away to illustrate the stitch loop configuration in the final courses of the second section, and illustrating a terry yarn being knit in plated relationship with the body yarn in the inner ply and forming terry loops extending outwardly therefrom; and FIG. 5 is a view similar to FIG. 4 but additionally illustrating elastic yarn inlaid in the body yarn stitch loops of the fabric.

As illustrated in FIGS. 1 and 2, the moisture absorbent band of the present invention includes a central opening and is adapted to be worn with a portion of the body extending therethrough. The band includes a first or outer cylindrical ply, broadly indicated at 10, of predetermined width, and a second or inner cylindrical ply, broadly indicated at 11, also of the same width as the first ply and being integrally knit at opposite sides with corresponding opposite side edges of the first ply 10. The second ply 11 is circumferentially divided intermediate opposite side edges thereof and defines first and second cylindrical sections 12, 13 with corresponding adjacent edges. A single layer of knit fabric of a relatively narrow width forms a single connector tab 14 which integrally connects the adjacent edges of the first and second sections 12, 13 in a manner to be presently described.

The first and second plies 10, 11 each include successive courses of stitch loops formed of a body yarn B (FIGS. 3–5) and these courses extend circumferentially of both plies of fabric to define parallel wales of stitch loops extending perpendicularly of the courses and continuously from one ply to the other. As illustrated in FIG. 3, the single layer connector tab 14 includes two times as many wales (wales W-1, W-2 and W-3) as are contained in the first and second plies 10, 11 (wales W-1 and W-3). The single layer connector tab 14 includes an initial course, indicated at C-65 in FIG. 3, wich is integrally knit with the initial or make-up course C-1 of the first section 12 and also integrally knit with the final course C-64 of the second section 13.

If desired, a terry yarn T may be knit in plated relationship with the body yarn B in either one or both of the first and second plies 10, 11 and forms outwardly extending terry loops in the sinker wales between needle wales, as illustrated between wales W-1 and W-3 of FIG. 4. Also, as illustrated in FIG. 5, an elastic yarn E may be inlaid in the courses of the stitch loops of the body yarn B to provide additional circumferential stretch and contraction of the band. The elastic yarn E can be incorporated in the fabric by knitting or inlaying and can be incorporated in either one or both of the inner and outer plies.

The moisture absorbent band of the present invention does not include the usual type of sewn seam connecting opposite ends of the length of tubular fabric. On the other hand, the adjacent edges of the first and second sections 12, 13 of the inner ply 11 are integrally joined together by the first course of the relatively narrow single layer connector tab 14. Since both plies 10, 11 and the connector tab 14 are knitted, the connector tab 14 does not limit the stretchability of the band and does not irritate the wearer. A moisture absorbent yarn is provided in at least certain courses of the band and the moisture absorbent yarn may be incorporated in the band in any well-known manner. If desired, the terry yarn T, the body yarn B, or both of these yarns may be of the moisture absorbent type. Also, a separate or additional moisture absorbent yarn may be incorporated in the band.

METHOD OF KNITTING

A moisture absorbent band of a size to be worn on the wrist can be knit on a circular hosiery knitting machine of the type which permits selected needles to pass the knitting station in a lowered inactive position while holding stitch loops thereon and while the remaining needles pass through and are engaged by the stitch cams to form stitch loops at the knitting station. To form a moisture absorbent band of sufficient diameter to encircle the head of the wearer, it may be necessary to utilize a circular knitting machine having a larger diameter needle cylinder and/or a greater number of needles.

The moisture absorbent band illustrated in the drawings is knit by first forming a make-up in the usual manner by feeding one or more rounds of yarn to alternate needles, and then feeding the yarn to all needles, and then holding the stitch loops formed on every other needle while knitting on the remaining needles to form a predetermined length of seamless fabric. The stitch holding or non-knitting needles pass beneath the stitch cams at a low or inactive position and continue to hold the loops thereon. A held stitch loop is illustrated in the non-knitting wale W-2 of course C-1 in FIGS. 3–5.

The terry yarn T (FIGS. 4 and 5) may be introduced and removed at any point in the knitting of the inner or outer plies 10, 11 and the terry loops are formed in the usual manner, as by feeding the terry yarn T over the nibs of the sinkers. Also, the elastic yarn E can be incorporated in any well-known manner and in any of the courses formed in either the inner or outer plies 10, 11. In FIG. 5 the elastic yarn E is illustrated as being inlaid in the courses in a well-known manner.

Upon completion of the knitting of the desired length of seamless fabric on every other needle, the non-knitting needles are moved to the active level to form a complete connector course with a stitch loop in each wale, as best illustrated at course C-65 in FIG. 3. As illustrated in FIG. 3, the stitch loop formed in wale W-2 of course C-65 is drawn through the loop which was held by the inactive needle during the knitting of the inner and outer plies 10, 11. Also, the stitch loops formed in wales W-1 and W-3 of course C-65 are drawn through the stitch loops in wales W-1 and W-3 of course C-64 so that the courses C-1 and C-64 are joined together and an outturned tube is automatically formed.

Several additional courses, such as courses C-66 through C-68 are then knit on all needles to complete the single layer connector tab 14. The final course C-68 of the connector tab 14 defines a free edge thereon. The yarn is then withdrawn from action and cut so that the completed moisture absorbent band is shed from the needles of the machine and the band is thus completed on the machine without requiring additional cutting and sewing operations. The single layer connector ply 14 is illustrated as including four courses which has been found to be sufficient to prevent raveling of the connector course C-65. However, a greater or lesser number of courses may be knit in the connector tab 14.

While the inner and outer plies 10, 11 of the band illustrated in the drawings are knit on every other needle, it is to be understood that the plies may be knit on other selections of the needles. For example, the plies 10, 11 may be knit on pairs of adjacent needles while holding stitch loops on single needles between the pairs of adjacent needles.

In the drawings and specification there has been set forth a preferred embodiment of the invention, and although specific terms are employed, they are used in a generic and descriptive sense only and not for purposes of limitation, the scope of the invention being defined in the claims.

That which is claimed is:

1. A moisture absorbent band including a central opening adapted to be worn with a portion of the body extending therethrough and comprising a. a cylindrical band of double ply knit fabric of predetermined width and including successive courses of body yarn stitch loops extending circumferentially of said band and defining parallel wales of stitch loops extending perpendicularly of said courses and continuously from one ply to the other of said band, b. a single connector tab, said connector tab comprising a single layer of knit fabric of a relatively narrow width and including successive courses of body yarn stitch loops and a greater number of wales than the number of wales contained in said double ply fabric, said single layer including an initial course integrally knit with the initial and the final courses of said band to integrally join the corresponding adjacent edges of said double ply fabric, said single layer including a final course defining a free edge, and c. said band including a moisture absorbent yarn in at least certain courses of said band.

2. A moisture absorbent band according to claim 1 wherein said body yarn comprises a stretch yarn, and wherein said moisture absorbent yarn comprises an additional yarn.

3. A moisture absorbent band according to claim 1 wherein said body yarn is moisture absorbent.

4. A moisture absorbent band according to claim 1 wherein said body yarn is moisture absorbent and including an elastic yarn incorporated in at least one ply of said double ply band.

5. A moisture absorbent band according to claim 1 including a moisture absorbent terry yarn knit with said body yarn in at least one ply of said double ply band.

6. A moisture absorbent band including a central opening adapted to be worn with a portion of the body extending therethrough and comprising a. a first cylindrical ply of knit fabric of predetermined width and including successive courses of body yarn stitch loops extending circumferentially of said first ply of fabric and defining parallel wales of stitch loops extending perpendicularly of said courses and from one side edge to the other of said first ply, b. a second cylindrical ply of knit fabric of the same width as said first ply and being integrally knit at opposite side edges with corresponding opposite sides of said first ply, said second ply including courses of body yarn stitch loops extending circumferentially of said second ply of fabric and defining parallel wales of stitch loops extending perpendicularly of said courses, said second ply being circumferentially divided intermediate opposite sides thereof and defining first and second sections with corresponding adjacent edges, c. each of said parallel wales of stitch loops extending continuously from said first ply to said second ply, d. a single connector tab, said connector tab comprising a single layer of knit fabric of a relatively narrow width and including successive courses of body yarn stitch loops extending circumferentially and including a greater number of wales than the number of wales contained in each of said first and second sections of said second ply, said single layer including an initial course integrally knit with the initial course of said first section and with the final course of said second section to integrally join the corresponding adjacent edges of said first and second sections to the initial course of said single layer, said single layer including a final course defining a free edge, and e. said band including a moisture absorbent yarn in at least certain courses of said band.

7. A moisture absorbent band according to claim 6 wherein said single layer connector tab (c) includes two times as many wales as the number of wales contained in said first and second sections of said second ply.

8. A moisture absorbent band according to claim 6 wherein said body yarn comprises a stretch yarn, and wherein said moisture absorbent yarn comprises an additional yarn.

9. A moisture absorbent band according to claim 6 including a terry yarn knit in plated relationship with said body yarn in both said first and second plies and forming terry loops extending outwardly therefrom.

10. A moisture absorbent band according to claim 6 including elastic yarn inlaid in said body yarn stitch loops of both said first and second plies.

11. A moisture absorbent band according to claim 6 including a terry yarn knit in plated relationship with said body yarn in both said first and second plies and forming terry loops extending outwardly therefrom, and elastic yarn inlaid in said body yarn stitch loops of both said first and second plies.

* * * * *